US010339859B2

(12) United States Patent
Nie

(10) Patent No.: US 10,339,859 B2
(45) Date of Patent: Jul. 2, 2019

(54) AMOLED PIXEL DRIVING CIRCUIT AND PIXEL DRIVING METHOD

(71) Applicant: Shenzhen China Star Optoelectronics Technology Co. Ltd., Shenzhen (CN)

(72) Inventor: Chenglei Nie, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 194 days.

(21) Appl. No.: 14/758,245

(22) PCT Filed: Apr. 1, 2015

(86) PCT No.: PCT/CN2015/075693

§ 371 (c)(1),
(2) Date: Jun. 29, 2015

(87) PCT Pub. No.: WO2016/123856

PCT Pub. Date: Aug. 11, 2016

(65) Prior Publication Data

US 2016/0307497 A1 Oct. 20, 2016

(30) Foreign Application Priority Data

Feb. 3, 2015 (CN) ..... 2015 1 0057134

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0819* (2013.01); *G09G 2300/0852* (2013.01); *G09G 2310/0251* (2013.01); *G09G 2320/0233* (2013.01); *G09G 2320/043* (2013.01); *G09G 2320/045* (2013.01)

(58) Field of Classification Search
CPC ..... G09G 3/3233; G09G 3/3241
See application file for complete search history.

(56) References Cited

U.S. PATENT DOCUMENTS

2005/0104819 A1* 5/2005 Shimoda ..... G09G 3/3283 345/76
2006/0125408 A1* 6/2006 Nathan ..... G09G 3/3233 315/169.3

* cited by examiner

*Primary Examiner* — Sepehr Azari
(74) *Attorney, Agent, or Firm* — Leong C. Lei

(57) ABSTRACT

The present invention provides an AMOLED pixel driving circuit and a pixel driving method. The AMOLED pixel driving circuit comprises: a first, a second, a third, a fourth, a fifth, a sixth thin film transistors (M1, M2, M3, M4, M5, M6), a first, a second capacitors (C1, C2) and an organic light emitting diode (D1); wherein the third thin film transistor (M3) is a mirror thin film transistor, and the fourth thin film transistor (M4) is a drive thin film transistor, and the second thin film transistor (M2) is located between the third and the fourth thin film transistors (M3, M4). By controlling activation and deactivation of the second thin film transistor (M2) according to time sequence with the restore signal (Restore), the source voltage of the third thin film transistor (M3) is controlled to be pulled down to the earth voltage level (GND) in the restore stage to ensure that ensure that the gate-source voltages of the third, the fourth thin film transistors (M3, M4) are equal. Meanwhile, the data signal can be efficiently simplified to increase the charge time of the data signal.

9 Claims, 6 Drawing Sheets

AMOLED PIXEL DRIVING CIRCUIT AND PIXEL DRIVING METHOD

FIELD OF THE INVENTION

The present invention relates to a display technology field, and more particularly to an AMOLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution. The AMOLED is a current driving element. When the electrical current flows through the organic light emitting diode, the organic light emitting diode emits light, and the brightness is determined according to the current flowing through the organic light emitting diode itself. In the AMOLED driving circuit, the threshold voltage of the drive thin film transistor will drift along with the working times. Thus, it results in that the luminescence of the OLED is unstable. Therefore, the pixel driving circuit which can compensate the drift of the threshold voltage of the drive thin film transistor is required to be utilized.

FIG. 1 shows an AMOLED pixel driving circuit according to prior art, comprising a second switch thin film transistor SW2, and a gate thereof is electrically coupled to an nth second scan control signal gate2(*n*), and a drain is electrically coupled to a data signal data, and a source is electrically coupled to a source of a mirror thin film transistor MR and one end of the second capacitor Cst2; the mirror thin film transistor MR, and a gate thereof is electrically coupled to a source of a drive thin film transistor DR via a first node D, and a drain is electrically coupled to a drain of a first switch thin film transistor SW1, and the source is electrically coupled to the source of the second switch thin film transistor SW2 and the one end of the second capacitor Cst2; the first switch thin film transistor SW1, and a gate thereof is electrically coupled to an nth first scan control signal gate1(*n*), and a drain is electrically coupled to the drain of the mirror thin film transistor MR, and a source is electrically coupled to the first node D; a pre-charge thin film transistor PC, and both a gate and a source thereof are electrically coupled to an n−1th second scan control signal Gate2(*n*−1), and a drain is electrically coupled to the first node D; the drive thin film transistor DR, and a gate thereof is electrically coupled to the gate of the mirror thin film transistor MR via the first node D, and a drain is electrically coupled to the ground GND, and a source is electrically coupled to an cathode of the organic light emitting diode OLED; one end of a first capacitor Cst1 is electrically coupled to the first node D, and the other end is electrically coupled to the ground GND; one end of a second capacitor Cst2 is electrically coupled to the source of the second switch thin film transistor SW2 and the source of the mirror thin film transistor MR, and the other end is electrically coupled to the ground GND; an anode of the organic light emitting diode OLED is electrically coupled to the power supply voltage VDD, and the cathode is electrically coupled to the source of the drive thin film transistor DR. FIG. 2 is a sequence diagram of an AMOLED pixel driving circuit shown in FIG. 1. The compensation procedure of the circuit sequentially comprises a Pre-charge stage, a Program stage, a Restore stage and a Drive stage, wherein in the restore stage, the gate voltages Vg of the drive thin film transistor DR and the mirror thin film transistor MR are equal, and the data signal data is required to be recovered to the ground GND to pull down the source voltage Vs of the mirror thin film transistor MR to make the gate-source voltage of the drive thin film transistor DR and the gate-source voltage of the mirror thin film transistor MR close. Then, both the stresses and the times of the voltages which the drive thin film transistor DR and the mirror thin film transistor MR are suffered are close. The threshold voltage drifts are close, too. Thus, the mirror thin film transistor MR can replace the drive thin film transistor DR to detect the threshold voltage for compensating the influence of the threshold voltage drift of the drive thin film transistor DR to the circuit. As shown in FIG. 3, the AMOLED pixel driving circuit according to prior art uses the way of recovering the data signal to the ground GND to achieve that the stresses of the gate-source voltages of the mirror thin film transistor MR and the drive thin film transistor DR are close. However, such way will shorten the charge time of the data signal Data.

SUMMARY OF THE INVENTION

An objective of the present invention is to provide an AMOLED pixel driving circuit, which can simplify the data signal to increase the charge time of the data signal and realize the normal driving of the panel under condition that the stresses of the gate-source voltages of the mirror thin film transistor and the drive thin film transistor are ensured to be close.

Another objective of the present invention is to provide an AMOLED pixel driving method, which can ensure that the stresses of the gate-source voltages of the mirror thin film transistor and the drive thin film transistor are close, and meanwhile, simplify the data signal to increase the charge time of the data signal and realize the normal driving of the panel.

For realizing the aforesaid objectives, the present invention provides an AMOLED pixel driving circuit, comprising: a first thin film transistor, a second thin film transistor, a third thin film transistor, a fourth thin film transistor, a fifth thin film transistor, a sixth thin film transistor, a first capacitor, a second capacitor and an organic light emitting diode;

a gate of the sixth thin film transistor is electrically coupled to an nth stage second scan control signal, and a drain is electrically coupled to a data signal, and a source is electrically coupled to a source of the third thin film transistor and one end of the first capacitor;

a gate of the third thin film transistor is electrically coupled to a gate of the fourth thin film transistor via a first node, and a drain is electrically coupled to the drain of the first thin film transistor, and the source is electrically coupled to the source of the sixth thin film transistor and the one end of the first capacitor;

a gate of the first thin film transistor is electrically coupled to an nth stage first scan control signal, and the drain is electrically coupled to the drain of the third thin film transistor, and a source is electrically coupled to the first node;

both a gate and a source of the fifth thin film transistor are electrically coupled to an n−1th stage second scan control signal, and a drain is electrically coupled to the first node;

a gate of the fourth thin film transistor is electrically coupled to the gate of the third thin film transistor via the first node, and a drain is electrically coupled to a earth voltage level, and a source is electrically coupled to a cathode of the organic light emitting diode;

a gate of the second thin film transistor is electrically coupled to a restore signal, and a source is electrically coupled to the source of the third thin film transistor, and a drain is electrically coupled to the drain of the fourth thin film transistor and earth voltage level;

the one end of the first capacitor is electrically coupled to the source of the sixth thin film transistor and the source of the third thin film transistor, and the other end is electrically coupled to the earth voltage level;

one end of the second capacitor is electrically coupled to the first node, and the other end is electrically coupled to the earth voltage level;

the anode of the organic light emitting diode is electrically coupled to a power supply voltage, and a cathode is electrically coupled to the source of the fourth thin film transistor;

the restore signal provides high, low alternate voltages according to time sequence to control whether a source voltage of the third thin film transistor is pulled down to the earth voltage level or not.

All of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

The third thin film transistor and the fourth thin film transistor are symmetrically located, and widths of channels of the two are similar; the fourth thin film transistor is a drive thin film transistor, and the third thin film transistor is a mirror thin film transistor.

The restore signal is an n+1th stage first scan control signal.

The data signal, the nth stage second scan control signal, the nth stage first scan control signal, the n−1th stage second scan control signal and the restore signal are combined with one another, and correspond to a pre-charge stage, a program stage and a drive stage one after another; an initialization of the drive stage is a restore stage;

in the restore stage, the restore signal provides high voltage level, and the second thin film transistor is activated, and the source voltage of the third thin film transistor is pulled down to the earth voltage level to make gate-source voltages of the third and the fourth thin film transistors equal; in other stages, the restore signal all provides low voltage level.

in the pre-charge stage, the data signal is low voltage level, and the nth stage second scan control signal is low voltage level, and the nth stage first scan control signal is low voltage level, and the n−1th stage second scan control signal is high voltage level, and the restore signal is low voltage level;

The data signal, the nth stage second scan control signal, the nth stage first scan control signal, the n−1th stage second scan control signal and the restore signal are combined with one another, and correspond to a pre-charge stage, a program stage and a drive stage one after another; an initialization of the drive stage is a restore stage;

in the restore stage, of which the drive stage is initialized, the data signal is low voltage level, and the nth stage second scan control signal is low voltage level, and the nth stage first scan control signal is low voltage level, and the n−1th stage second scan control signal is low voltage level, and the restore signal is high voltage level;

in the drive stage after the restore stage, the data signal is low voltage level, and the nth stage second scan control signal is low voltage level, and the nth stage first scan control signal is low voltage level, and the n−1th stage second scan control signal is low voltage level, and the restore signal is low voltage level.

The present invention further provides an AMOLED pixel driving circuit comprising: a first thin film transistor, a third thin film transistor, a fourth thin film transistor, a fifth thin film transistor, a sixth thin film transistor, a first capacitor, a second capacitor and an organic light emitting diode;

a gate of the sixth thin film transistor is electrically coupled to an nth stage second scan control signal, and a drain is electrically coupled to a data signal, and a source is electrically coupled to a source of the third thin film transistor and one end of the first capacitor;

a gate of the third thin film transistor is electrically coupled to a gate of the fourth thin film transistor via a first node, and a drain is electrically coupled to the drain of the first thin film transistor, and the source is electrically coupled to the source of the sixth thin film transistor and the one end of the first capacitor;

a gate of the first thin film transistor is electrically coupled to an nth stage first scan control signal, and the drain is electrically coupled to the drain of the third thin film transistor, and a source is electrically coupled to the first node;

both a gate and a source of the fifth thin film transistor are electrically coupled to an n−1th stage second scan control signal, and a drain is electrically coupled to the first node;

a gate of the fourth thin film transistor is electrically coupled to the gate of the third thin film transistor via the first node, and a drain is electrically coupled to a earth voltage level, and a source is electrically coupled to a cathode of the organic light emitting diode;

a gate of the second thin film transistor is electrically coupled to a restore signal, and a source is electrically coupled to the source of the third thin film transistor, and a drain is electrically coupled to the drain of the fourth thin film transistor and earth voltage level;

the one end of the first capacitor is electrically coupled to the source of the sixth thin film transistor and the source of the third thin film transistor, and the other end is electrically coupled to the earth voltage level;

one end of the second capacitor is electrically coupled to the first node, and the other end is electrically coupled to the earth voltage level;

the anode of the organic light emitting diode is electrically coupled to a power supply voltage, and a cathode is electrically coupled to the source of the fourth thin film transistor;

the restore signal provides high, low alternate voltages according to time sequence to control whether a source voltage of the third thin film transistor is pulled down to the earth voltage level or not;

wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors;

wherein the third thin film transistor and the fourth thin film transistor are symmetrically located, and widths of channels of the two are similar; the fourth thin film transistor is a drive thin film transistor, and the third thin film transistor is a mirror thin film transistor.

The present invention further provides an AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a first capacitor, a second capacitor and an organic light emitting diode;

a gate of the sixth thin film transistor is electrically coupled to an nth stage second scan control signal, and a drain is electrically coupled to a data signal, and a source is electrically coupled to a source of the third thin film transistor and one end of the first capacitor;

a gate of the third thin film transistor is electrically coupled to a gate of the fourth thin film transistor via a first node, and a drain is electrically coupled to the drain of the first thin film transistor, and the source is electrically coupled to the source of the sixth thin film transistor and the one end of the first capacitor;

a gate of the first thin film transistor is electrically coupled to an nth stage first scan control signal, and the drain is electrically coupled to the drain of the third thin film transistor, and a source is electrically coupled to the first node;

both a gate and a source of the fifth thin film transistor are electrically coupled to an n−1th stage second scan control signal, and a drain is electrically coupled to the first node;

a gate of the fourth thin film transistor is electrically coupled to the gate of the third thin film transistor via the first node, and a drain is electrically coupled to a earth voltage level, and a source is electrically coupled to a cathode of the organic light emitting diode;

a gate of the second thin film transistor is electrically coupled to a restore signal, and a source is electrically coupled to the source of the third thin film transistor, and a drain is electrically coupled to the drain of the fourth thin film transistor and the earth voltage level; the one end of the first capacitor is electrically coupled to the source of the sixth thin film transistor and the source of the third thin film transistor, and the other end is electrically coupled to the earth voltage level;

one end of the second capacitor is electrically coupled to the first node, and the other end is electrically coupled to the earth voltage level;

the anode of the organic light emitting diode is electrically coupled to a power supply voltage, and a cathode is electrically coupled to the source of the fourth thin film transistor;

step 2, entering a pre-charge stage;

the data signal provides high voltage level, and the nth stage second scan control signal provides low voltage level, and the nth stage first scan control signal provides low voltage level, and the n−1th stage second scan control signal provides high voltage level, and the restore signal provides low voltage level, and the first node, the gate of the third thin film transistor and the gate of the fourth thin film transistor are pre-charged to the same voltage level;

step 3, entering a program stage;

the data signal provides high voltage level, and the nth stage second scan control signal provides high voltage level, and the nth stage first scan control signal provides high voltage level, and the n−1th stage second scan control signal provides low voltage level, and the restore signal provides low voltage level, and the data signal is programmed into the first node, the gate of the third thin film transistor and the gate of the fourth thin film transistor, and meanwhile, the source voltage of the third thin film transistor is raised;

step 4, entering a drive stage;

first, entering the restore stage, of which the drive stage is initialized, the data signal provides low voltage level, and the nth stage second scan control signal provides low voltage level, and the nth stage first scan control signal provides low voltage level, and the n−1th stage second scan control signal provides low voltage level, and the restore signal provides high voltage level, and the second thin film transistor is activated, and the source voltage of the third thin film transistor is pulled down to the earth voltage level to make gate-source voltages of the third and the fourth thin film transistors equal;

then, entering the following stage of the drive stage, the restore signal is changed to be low voltage level, and the organic light emitting diode emits light.

All of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

The third thin film transistor and the fourth thin film transistor are symmetrically located, and widths of channels of the two are similar; the fourth thin film transistor is a drive thin film transistor, and the third thin film transistor is a mirror thin film transistor.

The restore signal is an n+1th stage first scan control signal.

The benefits of the present invention are: the AMOLED pixel driving circuit and pixel circuit driving method provided by the present invention locates the second thin film transistor controlled by the restore signal between the third thin film transistor and the fourth thin film transistor, i.e. the mirror thin film transistor and the drive thin film transistor and controls the source voltage of the third thin film transistor, i.e. the mirror thin film transistor to be pulled down to the earth voltage level in the restore stage with the restore signal to make the gate-source voltages of the third and the fourth thin film transistors, i.e. the mirror thin film transistor and the drive thin film transistor equal. Compared with the way of recovering the data signal to the earth voltage level, this method can simplifies the data signal to increase the charge time of the data signal and realize the normal driving of the panel.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
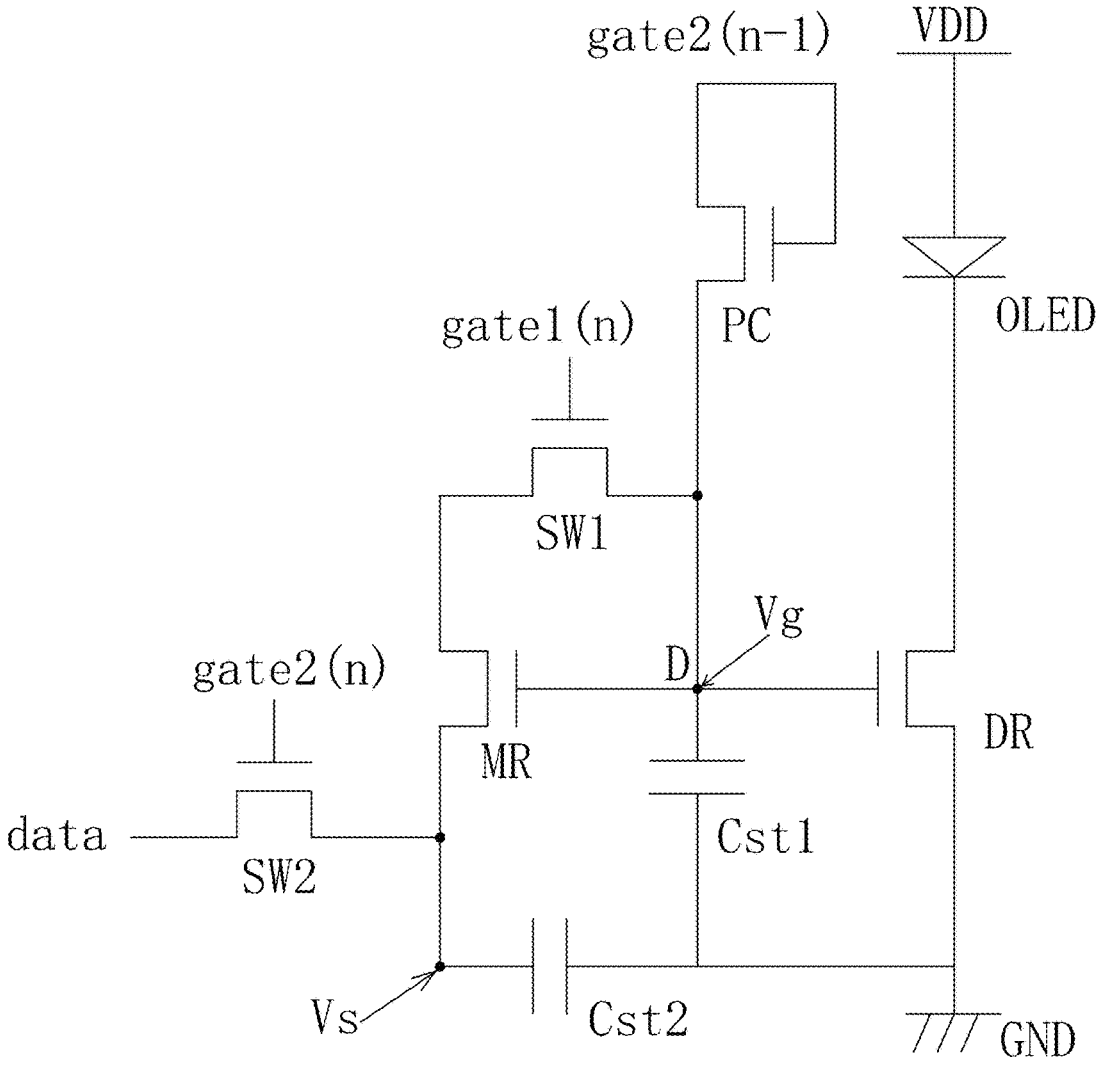
Fig. 1 (Prior Art)
FIG. 1 is a circuit diagram of an AMOLED pixel driving circuit according to prior art.
Figure 2:
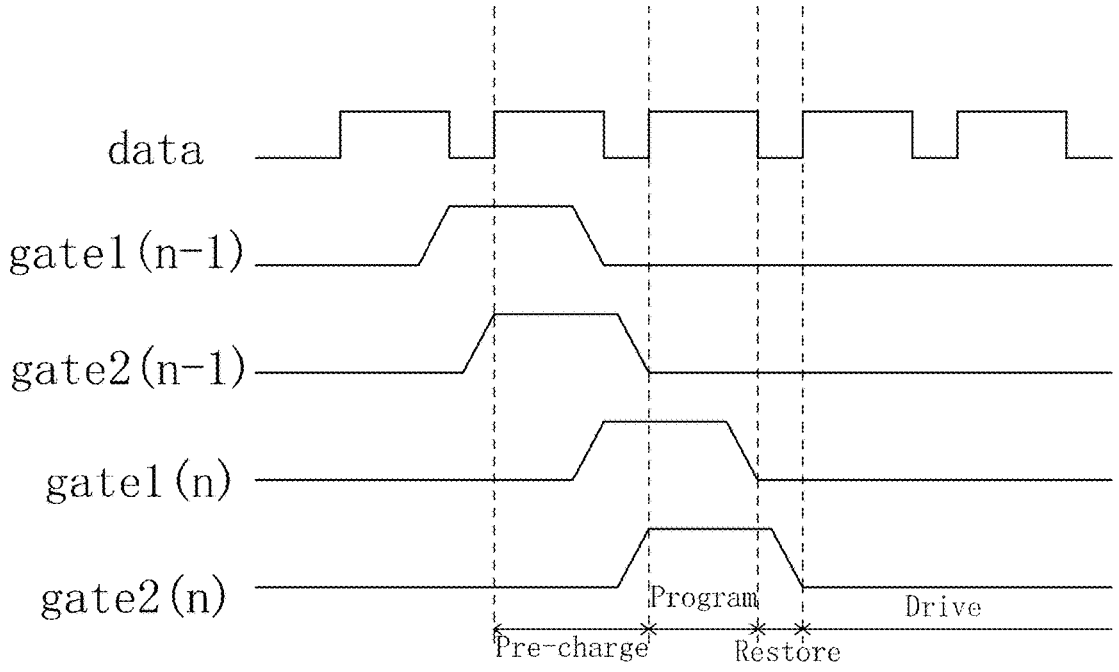
Fig. 2 (Prior Art)
FIG. 2 is a sequence diagram of an AMOLED pixel driving circuit shown in FIG. 1.
Figure 3:
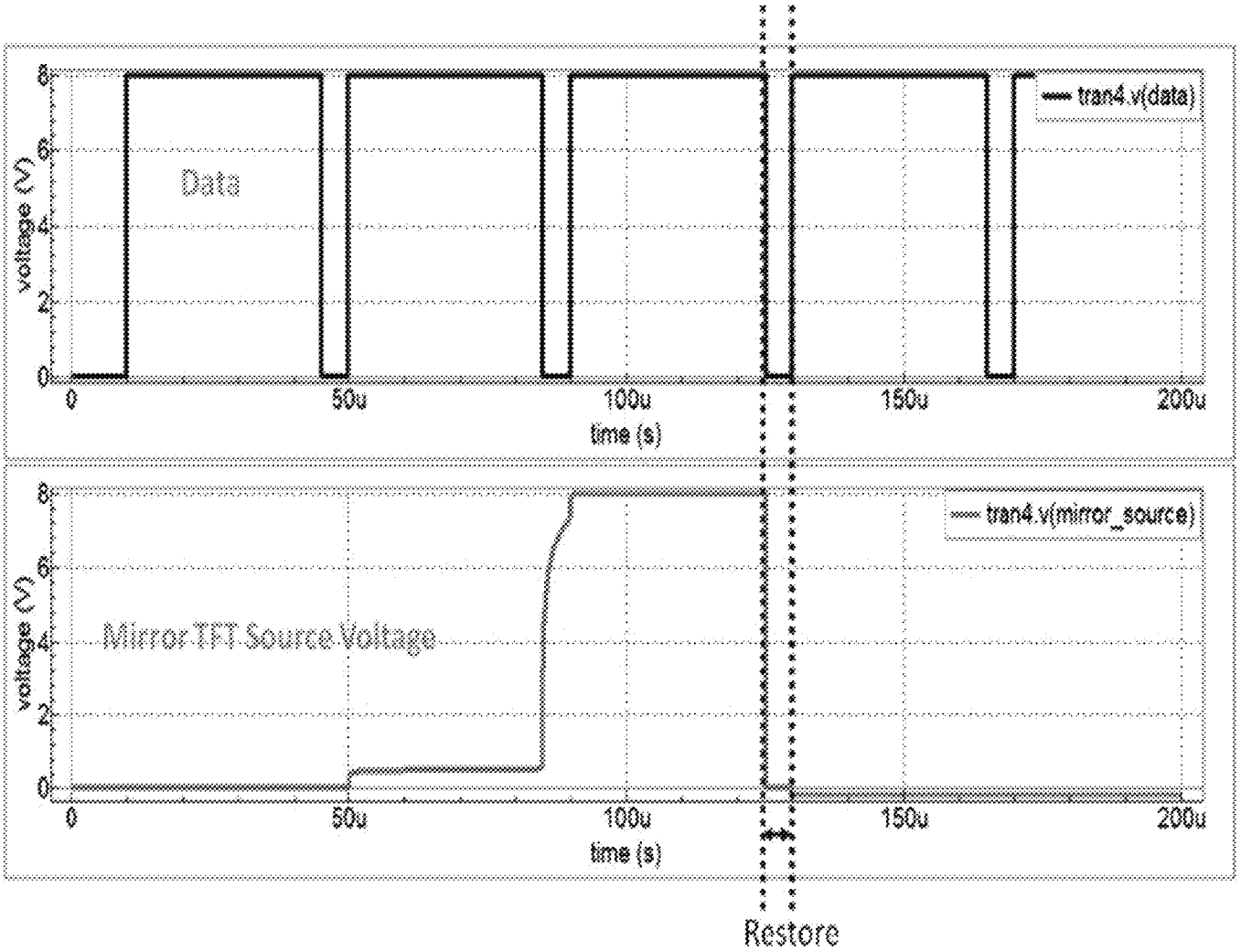
Fig. 3 (Prior Art)
FIG. 3 is a relationship diagram of the data signal and the source voltage of the mirror thin film transistor of the AMOLED pixel driving circuit shown in FIG. 1.
Figure 4:
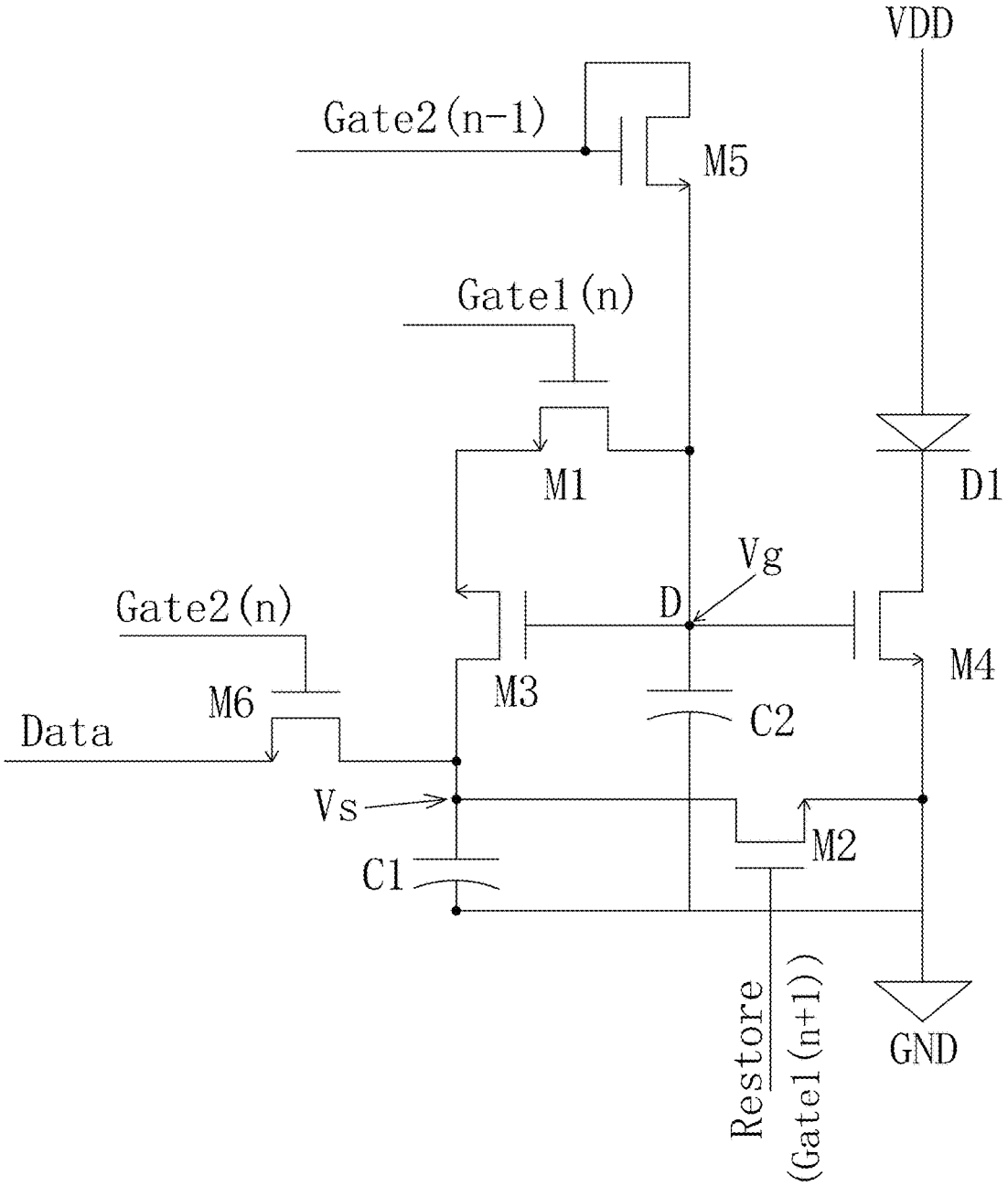
FIG. 4 is a circuit diagram of an AMOLED pixel driving circuit according to the present invention.

Please refer to FIG. 4. The present invention first provides an AMOLED pixel driving circuit, comprising a first thin film transistor M1, a second thin film transistor M2, a third thin film transistor M3, a fourth thin film transistor M4, a fifth thin film transistor M5, a sixth thin film transistor M6, a first capacitor C1, a second capacitor C2 and an organic light emitting light diode D1.

A gate of the sixth thin film transistor M6 is electrically coupled to an nth stage second scan control signal Gate2($n$), and a drain is electrically coupled to a data signal Data, and a source is electrically coupled to a source of the third thin film transistor M3 and one end of the first capacitor C1; a gate of the third thin film transistor M3 is electrically coupled to a gate of the fourth thin film transistor M4 via a first node D, and a drain is electrically coupled to the drain of the first thin film transistor M1, and the source is electrically coupled to the source of the sixth thin film transistor M6 and the one end of the first capacitor C1; a gate of the first thin film transistor M1 is electrically coupled to an nth stage first scan control signal Gate1($n$), and the drain is electrically coupled to the drain of the third thin film transistor M3, and a source is electrically coupled to the first node D; both a gate and a source of the fifth thin film transistor M5 are electrically coupled to an n−1th stage second scan control signal Gate2($n$−1), and a drain is electrically coupled to the first node D; a gate of the fourth thin film transistor M4 is electrically coupled to the gate of the third thin film transistor M3 via the first node D, and a drain is electrically coupled to a earth voltage level GND, and a source is electrically coupled to a cathode of the organic light emitting diode D1; a gate of the second thin film transistor M2 is electrically coupled to a restore signal Restore, and a source is electrically coupled to the source of the third thin film transistor M3, and a drain is electrically coupled to the drain of the fourth thin film transistor M4 and the earth voltage level GND; the one end of the first capacitor C1 is electrically coupled to the source of the sixth thin film transistor M6 and the source of the third thin film transistor M3, and the other end is electrically coupled to the earth voltage level GND; one end of the second capacitor C2 is electrically coupled to the first node D, and the other end is electrically coupled to the earth voltage level GND; the anode of the organic light emitting diode D1 is electrically coupled to a power supply voltage VDD, and a cathode is electrically coupled to the source of the fourth thin film transistor M4.

Specifically, all of the first thin film transistor M1, the second thin film transistor M2, the third thin film transistor M3, the fourth thin film transistor M4, the fifth thin film transistor M5 and the sixth thin film transistor M6 are Low Temperature Poly-silicon thin film transistors, oxide semiconductor thin film transistors or amorphous silicon thin film transistors. The third thin film transistor and the fourth thin film transistor M3, M4 are symmetrically located, and widths of channels of the two are similar; the fourth thin film transistor M4 is a drive thin film transistor, and the third thin film transistor M3 is a mirror thin film transistor.

Figure 5:
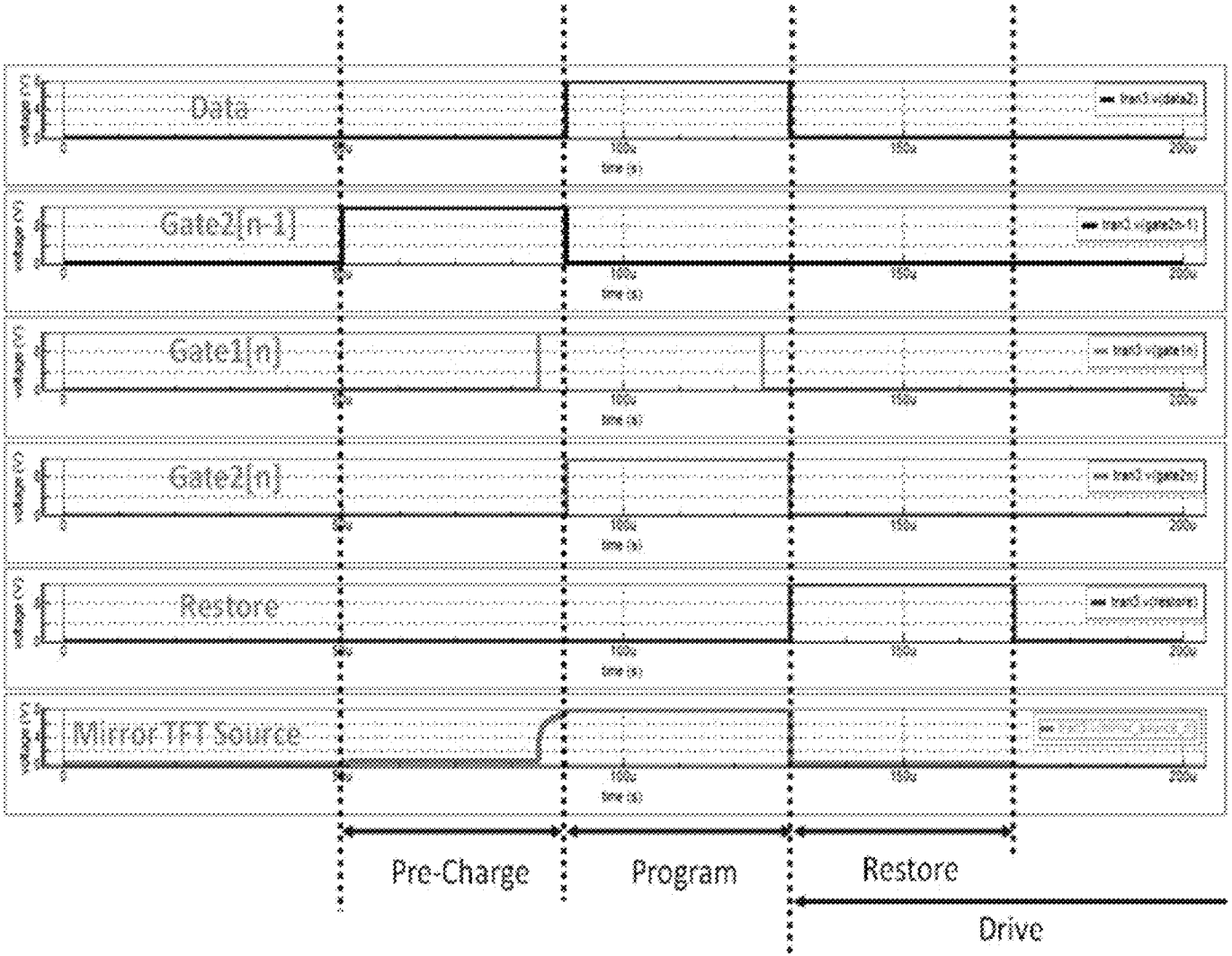
FIG. 5 is a sequence diagram of an AMOLED pixel driving circuit according to the present invention.

With combination of FIG. 5, the restore signal Restore provides high, low alternate voltages according to time sequence to control whether a source voltage of the third thin film transistor M3 is pulled down to the earth voltage level GND or not. Preferably, the restore signal Restore is an n+1th stage first scan control signal Gate1($n$+1), which the present signal can be employed to obtain without extra added signals and is beneficial to simplify the circuit structure.

As shown in FIG. 5, the data signal Data, the nth stage second scan control signal Gate2($n$), the nth stage first scan control signal Gate1($n$), the n−1th stage second scan control signal Gate2($n$−1) and the restore signal Restore are combined with one another, and correspond to a pre-charge stage, a program stage and a drive stage one after another; an initialization of the drive stage is a restore stage.

Specifically, in the pre-charge stage, the data signal Data is low voltage level, and the nth stage second scan control signal Gate2($n$) is low voltage level, and the nth stage first scan control signal Gate1($n$) is low voltage level, and the n−1th stage second scan control signal Gate2($n$−1) is high voltage level, and the restore signal Restore is low voltage level; in the program stage, the data signal Data is high voltage level, and the nth stage second scan control signal Gate2($n$) is high voltage level, and the nth stage first scan control signal Gate1($n$) is high voltage level, and the n−1th stage second scan control signal Gate2($n$−1) is low voltage level, and the restore signal Restore is low voltage level; in the restore stage, of which the drive stage is initialized, the data signal Data is low voltage level, and the nth stage second scan control signal Gate2($n$) is low voltage level, and the nth stage first scan control signal Gate1($n$) is low voltage level, and the n−1th stage second scan control signal Gate2($n$−1) is low voltage level, and the restore signal Restore is high voltage level, and the second thin film transistor M2 is activated, and the source voltage of the third thin film transistor M3 is pulled down to the earth voltage level GND to make gate-source voltages of the third and the fourth thin film transistors M3, M4 equal; in the drive stage after the restore stage, the data signal Data is low voltage level, and the nth stage second scan control signal Gate2($n$) is low voltage level, and the nth stage first scan control signal Gate1($n$) is low voltage level, and the n−1th stage second scan control signal Gate2($n$−1) is low voltage level, and the restore signal Restore is low voltage level, and the organic light emitting diode D1 emits light.

Figure 6:
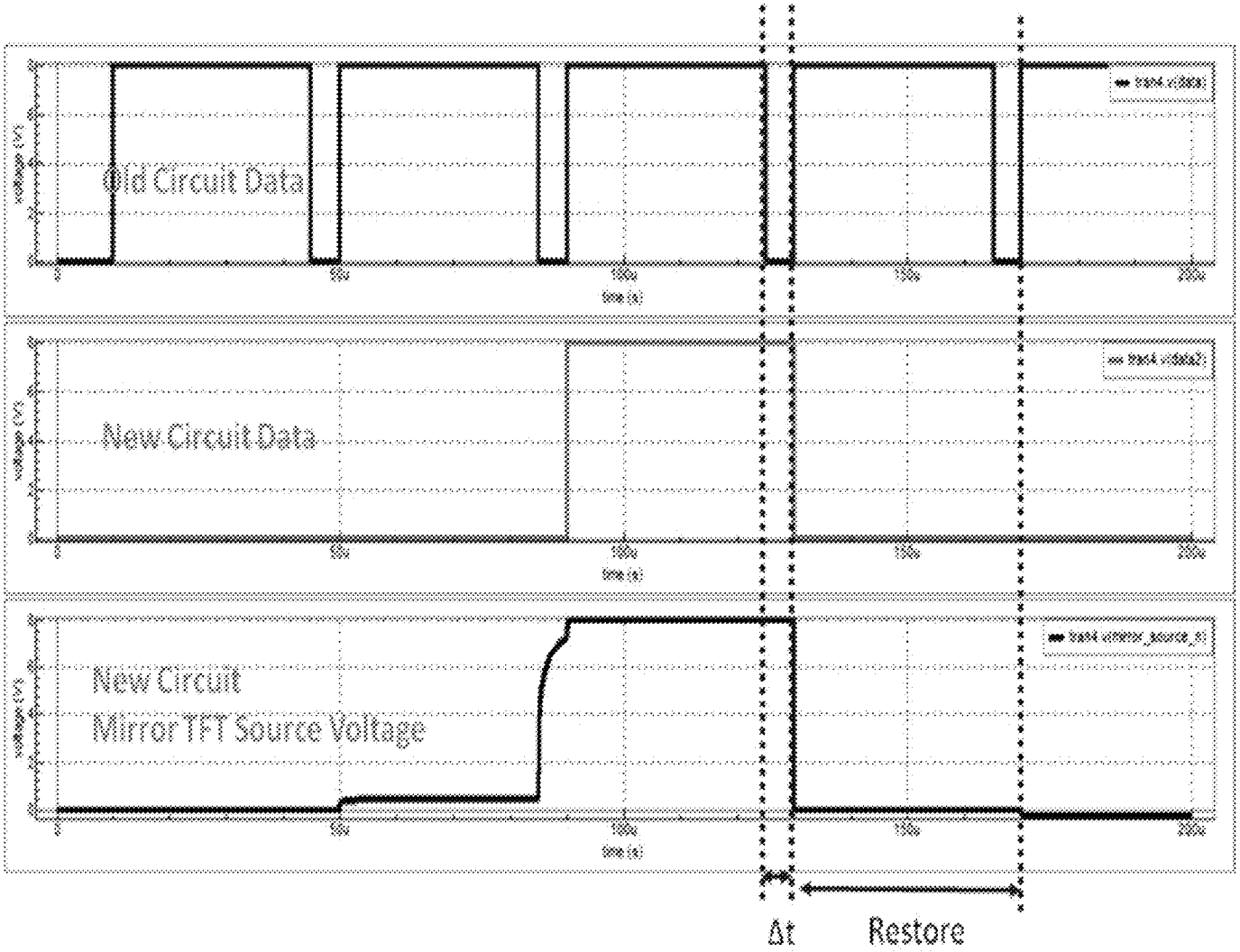
FIG. 6 is a relationship comparison diagram of the data signals and the source voltages of the mirror thin film transistors of the AMOLED pixel driving circuit according to the present invention and the AMOLED pixel driving circuit according to prior art.

Please refer to FIG. 6. The AMOLED pixel driving of the present invention controls activation and deactivation of the second thin film transistor M2 according to time sequence with the restore signal Restore to control the source voltage of the third thin film transistor M3 to be pulled down to the earth voltage level GND. Compared with the preset way of recovering the data signal Data to the earth voltage level to pull down the source voltage of the mirror thin film transistor, this method does not only ensure that the stresses of the gate-source voltages of the third and the fourth thin film transistors M3, M4, i.e. the mirror thin film transistor and the drive thin film transistor are close, but also simplifies the data signal Data to increase the charge time of the data signal Data with Δt.

Please refer to FIG. 5 in conjunction with FIG. 4. The present invention further provides an AMOLED pixel driving method, comprising steps of:

step 1, providing an AMOLED pixel driving circuit as shown in the aforesaid FIG. 4, and the description of the circuit is not repeated here. All of the first thin film transistor M1, the second thin film transistor M2, the third thin film transistor M3, the fourth thin film transistor M4, the fifth thin film transistor M5 and the sixth thin film transistor M6 in the AMOLED pixel driving circuit are Low Temperature Polysilicon thin film transistors, oxide semiconductor thin film transistors or amorphous silicon thin film transistors. The third thin film transistor and the fourth thin film transistor M3, M4 are symmetrically located, and widths of channels of the two are similar, and the fourth thin film transistor M4 is a drive thin film transistor, and the third thin film transistor M3 is a mirror thin film transistor.

The restore signal Restore provides high, low alternate voltages according to time sequence. Preferably, the restore signal Restore is an n+1th stage first scan control signal Gate1($n$−1).

step 2, entering a pre-charge stage.

The restore signal Restore provides high voltage level, and the nth stage second scan control signal Gate2($n$) provides low voltage level, and the nth stage first scan control signal Gate1($n$) provides low voltage level, and the n−1th stage second scan control signal Gate2($n$−1) provides high voltage level, and the restore signal Restore provides low voltage level. The fifth thin film transistor M5 is activated, and the first node D, the gate of the third thin film transistor M3 and the gate of the fourth thin film transistor M4 are pre-charged to the same voltage level.

step 3, entering a program stage.

The data signal Data provides high voltage level, and the nth stage second scan control signal Gate2($n$) provides high voltage level, and the nth stage first scan control signal Gate1($n$) provides high voltage level, and the n−1th stage second scan control signal Gate2($n$−1) provides low voltage level, and the restore signal Restore provides low voltage level. Both the sixth, the third, the first thin film transistors are activated, and the data signal Data is programmed into the first node D, the gate of the third thin film transistor M3 and the gate of the fourth thin film transistor M4 to make the gate voltages Vg of the third and the fourth thin film transistors M3, M4, i.e. the mirror thin film transistor and the drive thin film transistor equal, and meanwhile, the source voltage Vs of the third thin film transistor M3 is raised.

step 4, entering a drive stage;

First, entering the restore stage, of which the drive stage is initialized, the data signal Data provides low voltage level, and the nth stage second scan control signal Gate2($n$) provides low voltage level, and the nth stage first scan control signal Gate1($n$) provides low voltage level, and the n−1th stage second scan control signal Gate2($n$−1) provides low voltage level, and the restore signal Restore provides high voltage level. The second thin film transistor M2 is activated under the control of the restore signal Restore, and the source voltage Vs of the third thin film transistor M3 is pulled down to the earth voltage level GND to make gate-source voltages of the third and the fourth thin film transistors M3, M4, i.e. the drive thin film transistor and the mirror thin film transistor equal.

Then, entering the following stage of the drive stage, the restore signal Restore is changed to be low voltage level, and the organic light emitting diode D1 emits light.

As shown in FIG. 6, the AMOLED pixel driving of the present invention controls the source voltage Vs of the third thin film transistor M3 to be pulled down to the earth voltage level GND with the restore signal Restore. Compared with the preset way of recovering the data signal Data to the earth voltage level to pull down the source voltage of the mirror thin film transistor, this method does not only ensure that the stresses of the gate-source voltages of the third and the fourth thin film transistors M3, M4, i.e. the mirror thin film transistor and the drive thin film transistor are close, but also simplifies the data signal Data to increase the charge time of the data signal Data with Δt.

The AMOLED pixel driving circuit and pixel circuit driving method provided by the present invention locates the second thin film transistor controlled by the restore signal between the third thin film transistor and the fourth thin film transistor, i.e. the mirror thin film transistor and the drive thin film transistor and controls the source voltage of the third thin film transistor, i.e. the mirror thin film transistor to be pulled down to the earth voltage level in the restore stage with the restore signal to make the gate-source voltages of the third and the fourth thin film transistors, i.e. the mirror thin film transistor and the drive thin film transistor equal. Compared with the way of recovering the data signal to the earth voltage level, this method can simplifies the data signal to increase the charge time of the data signal and realize the normal driving of the panel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel driving circuit having a current mirror configuration comprises: a first thin film transistor, a second thin film transistor, a third thin film transistor, a fourth thin film transistor, a fifth thin film transistor, a sixth thin film transistor, a first capacitor, a second capacitor and an organic light emitting diode;

a gate of the sixth thin film transistor is electrically coupled to an nth stage second scan control signal, and a drain is electrically coupled to a data signal, and a source is electrically coupled to a source of the third thin film transistor and one end of the first capacitor;

a gate of the third thin film transistor is electrically coupled to a gate of the fourth thin film transistor via a first node, and a drain is electrically coupled to the drain of the first thin film transistor, and the source is electrically coupled to the source of the sixth thin film transistor and the one end of the first capacitor;

a gate of the first thin film transistor is electrically coupled to an nth stage first scan control signal, and the drain is electrically coupled to the drain of the third thin film transistor, and a source is electrically coupled to the first node;

both a gate and a source of the fifth thin film transistor are electrically coupled to an n−1th stage second scan control signal, and a drain is electrically coupled to the first node;

a gate of the fourth thin film transistor is electrically coupled to the gate of the third thin film transistor via the first node, and a drain is electrically coupled to an earth voltage level, and a source is electrically coupled to a cathode of the organic light emitting diode;

a gate of the second thin film transistor is electrically coupled to a restore signal, and a source is electrically coupled to the source of the third thin film transistor, and a drain is electrically coupled to the drain of the fourth thin film transistor and the earth voltage level;

the one end of the first capacitor is electrically coupled to the source of the sixth thin film transistor and the source of the third thin film transistor, and the other end is electrically coupled to the earth voltage level;

one end of the second capacitor is electrically coupled to the first node, and the other end is electrically coupled to the earth voltage level;

the anode of the organic light emitting diode is electrically coupled to a power supply voltage, and a cathode is electrically coupled to the source of the fourth thin film transistor;

wherein the third thin film transistor and the fourth thin film transistor are symmetrically located; the fourth thin film transistor is a drive thin film transistor, and the third thin film transistor is a mirror thin film transistor;

the restore signal, which is an n+1th stage first scan control signal, provides high, low alternate voltages to control activation and deactivation of the second thin film transistor according to time sequence to control whether a source voltage of the third thin film transistor is pulled down to the earth voltage level or not in order to simplify the data signal to increase a charge time of the data signal with Δt to ensure stresses of gate-source voltages of the drive thin film transistor and the mirror thin film transistor close to each other; and wherein in a combination of the mirror thin film transistor and the drive thin film transistor that are arranged such that the gates of mirror thin film transistor and the drive thin film transistor are connected to each other and the drain of the drive thin film transistor is connected to the earth voltage level, the source of the mirror thin film transistor is connected to the earth voltage level via the second thin film transistor, wherein the source voltage of the mirror thin film transistor is pulled down to the earth voltage level after a single pulse of the data signal is fed to the combination of the mirror thin film transistor and the drive thin film transistor so as to have gate-source voltages of the mirror thin film transistor and the drive thin film transistor equal to each other.

2. The AMOLED pixel driving circuit having a current mirror configuration according to claim 1, wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

3. The AMOLED pixel driving circuit having a current mirror configuration according to claim 1, wherein the data signal, the nth stage second scan control signal, the nth stage first scan control signal, the n−1th stage second scan control signal and the restore signal are combined with one another, and correspond to a pre-charge stage, a program stage and a drive stage one after another; an initialization of the drive stage is a restore stage;

in the restore stage, the restore signal provides high voltage level, and the second thin film transistor is activated, and the source voltage of the third thin film transistor is pulled down to the earth voltage level to make gate-source voltages of the third and the fourth thin film transistors equal; in other stages, the restore signal all provides low voltage level.

4. The AMOLED pixel driving circuit having a current mirror configuration according to claim 3, wherein, in the pre-charge stage, the data signal is low voltage level, and the nth stage second scan control signal is low voltage level, and the nth stage first scan control signal is low voltage level, and the n−1th stage second scan control signal is high voltage level, and the restore signal is low voltage level;

in the program stage, the data signal is high voltage level, and the nth stage second scan control signal is high voltage level, and the nth stage first scan control signal is high voltage level, and the n−1th stage second scan control signal is low voltage level, and the restore signal is low voltage level;

in the restore stage, of which the drive stage is initialized, the data signal is low voltage level, and the nth stage second scan control signal is low voltage level, and the nth stage first scan control signal is low voltage level, and the n−1th stage second scan control signal is low voltage level, and the restore signal is high voltage level;

in the drive stage after the restore stage, the data signal is low voltage level, and the nth stage second scan control signal is low voltage level, and the nth stage first scan control signal is low voltage level, and the n−1th stage second scan control signal is low voltage level, and the restore signal is low voltage level.

5. An AMOLED pixel driving circuit having a current mirror configuration comprises: a first thin film transistor, a second thin film transistor, a third thin film transistor, a fourth thin film transistor, a fifth thin film transistor, a sixth thin film transistor, a first capacitor, a second capacitor and an organic light emitting diode;

a gate of the sixth thin film transistor is electrically coupled to an nth stage second scan control signal, and a drain is electrically coupled to a data signal, and a source is electrically coupled to a source of the third thin film transistor and one end of the first capacitor;

a gate of the third thin film transistor is electrically coupled to a gate of the fourth thin film transistor via a first node, and a drain is electrically coupled to the drain of the first thin film transistor, and the source is electrically coupled to the source of the sixth thin film transistor and the one end of the first capacitor;

a gate of the first thin film transistor is electrically coupled to an nth stage first scan control signal, and the drain is electrically coupled to the drain of the third thin film transistor, and a source is electrically coupled to the first node;

both a gate and a source of the fifth thin film transistor are electrically coupled to an n−1th stage second scan control signal, and a drain is electrically coupled to the first node;

a gate of the fourth thin film transistor is electrically coupled to the gate of the third thin film transistor via the first node, and a drain is electrically coupled to an earth voltage level, and a source is electrically coupled to a cathode of the organic light emitting diode;

a gate of the second thin film transistor is electrically coupled to a restore signal, and a source is electrically coupled to the source of the third thin film transistor, and a drain is electrically coupled to the drain of the fourth thin film transistor and the earth voltage level;

the one end of the first capacitor is electrically coupled to the source of the sixth thin film transistor and the source of the third thin film transistor, and the other end is electrically coupled to the earth voltage level;

one end of the second capacitor is electrically coupled to the first node, and the other end is electrically coupled to the earth voltage level;

the anode of the organic light emitting diode is electrically coupled to a power supply voltage, and a cathode is electrically coupled to the source of the fourth thin film transistor;

wherein the third thin film transistor and the fourth thin film transistor are symmetrically located; the fourth thin film transistor is a drive thin film transistor, and the third thin film transistor is a mirror thin film transistor;

the restore signal, which is an n+1th stage first scan control signal, provides high, low alternate voltages to control activation and deactivation of the second thin film transistor according to time sequence to control whether a source voltage of the third thin film transistor is pulled down to the earth voltage level or not in order to simplify the data signal to increase a charge time of the data signal with Δt to ensure stresses of gate-source voltages of the drive thin film transistor and the mirror thin film transistor close to each other;

wherein in a combination of the mirror thin film transistor and the drive thin film transistor that are arranged such that the gates of mirror thin film transistor and the drive thin film transistor are connected to each other and the drain of the drive thin film transistor is connected to the earth voltage level, the source of the mirror thin film transistor is connected to the earth voltage level via the second thin film transistor, wherein the source voltage of the mirror thin film transistor is pulled down to the earth voltage level after a single pulse of the data signal is fed to the combination of the mirror thin film transistor and the drive thin film transistor so as to have gate-source voltages of the mirror thin film transistor and the drive thin film transistor equal to each other; and wherein all of the first thin film transistor, the second thin film transistor, the third thin film transistor, the fourth thin film transistor, the fifth thin film transistor and the sixth thin film transistor are Low Temperature Polysilicon thin film transistors, oxide semiconductor thin film transistors or amorphous silicon thin film transistors.

6. The AMOLED pixel driving circuit having a current mirror configuration according to claim 5, wherein the data signal, the nth stage second scan control signal, the nth stage first scan control signal, the n−1th stage second scan control signal and the restore signal are combined with one another, and correspond to a pre-charge stage, a program stage and a drive stage one after another; an initialization of the drive stage is a restore stage;

in the restore stage, the restore signal provides high voltage level, and the second thin film transistor is activated, and the source voltage of the third thin film transistor is pulled down to the earth voltage level to make gate-source voltages of the third and the fourth thin film transistors equal; in other stages, the restore signal all provides low voltage level.

7. The AMOLED pixel driving circuit having a current mirror configuration according to claim 6, wherein, in the pre-charge stage, the data signal is low voltage level, and the nth stage second scan control signal is low voltage level, and the nth stage first scan control signal is low voltage level, and the n−1th stage second scan control signal is high voltage level, and the restore signal is low voltage level;

in the program stage, the data signal is high voltage level, and the nth stage second scan control signal is high voltage level, and the nth stage first scan control signal is high voltage level, and the n−1th stage second scan control signal is low voltage level, and the restore signal is low voltage level;

in the restore stage, of which the drive stage is initialized, the data signal is low voltage level, and the nth stage second scan control signal is low voltage level, and the nth stage first scan control signal is low voltage level, and the n−1th stage second scan control signal is low voltage level, and the restore signal is high voltage level;

in the drive stage after the restore stage, the data signal is low voltage level, and the nth stage second scan control signal is low voltage level, and the nth stage first scan control signal is low voltage level, and the n−1th stage second scan control signal is low voltage level, and the restore signal is low voltage level.

8. An AMOLED pixel driving method, comprising steps of:

step 1, providing an AMOLED pixel driving circuit having a current mirror configuration;

the AMOLED pixel driving circuit having the current mirror configuration comprises: a first thin film transistor, a second thin film transistor, a third thin film transistor, a fourth thin film transistor, a fifth thin film transistor, a sixth thin film transistor, a first capacitor, a second capacitor and an organic light emitting diode;

a gate of the sixth thin film transistor is electrically coupled to an nth stage second scan control signal, and a drain is electrically coupled to a data signal, and a source is electrically coupled to a source of the third thin film transistor and one end of the first capacitor;

a gate of the third thin film transistor is electrically coupled to a gate of the fourth thin film transistor via a first node, and a drain is electrically coupled to the drain of the first thin film transistor, and the source is electrically coupled to the source of the sixth thin film transistor and the one end of the first capacitor;

a gate of the first thin film transistor is electrically coupled to an nth stage first scan control signal, and the drain is electrically coupled to the drain of the third thin film transistor, and a source is electrically coupled to the first node;

both a gate and a source of the fifth thin film transistor are electrically coupled to an n−1th stage second scan control signal, and a drain is electrically coupled to the first node;

a gate of the fourth thin film transistor is electrically coupled to the gate of the third thin film transistor via the first node, and a drain is electrically coupled to an earth voltage level, and a source is electrically coupled to a cathode of the organic light emitting diode;

a gate of the second thin film transistor is electrically coupled to a restore signal, and a source is electrically coupled to the source of the third thin film transistor, and a drain is electrically coupled to the drain of the fourth thin film transistor and the earth voltage level;

the one end of the first capacitor is electrically coupled to the source of the sixth thin film transistor and the source of the third thin film transistor, and the other end is electrically coupled to the earth voltage level;

one end of the second capacitor is electrically coupled to the first node, and the other end is electrically coupled to the earth voltage level;

the anode of the organic light emitting diode is electrically coupled to a power supply voltage, and a cathode is electrically coupled to the source of the fourth thin film transistor;

step 2, entering a pre-charge stage;

the data signal provides high voltage level, and the nth stage second scan control signal provides low voltage level, and the nth stage first scan control signal provides low voltage level, and the n−1th stage second scan control signal provides high voltage level, and the restore signal provides low voltage level, and the first node, the gate of the third thin film transistor and the gate of the fourth thin film transistor are pre-charged to the same voltage level;

step 3, entering a program stage;

the data signal provides high voltage level, and the nth stage second scan control signal provides high voltage level, and the nth stage first scan control signal provides high voltage level, and the n−1th stage second scan control signal provides low voltage level, and the restore signal provides low voltage level, and the data signal is programmed into the first node, the gate of the third thin film transistor and the gate of the fourth thin film transistor, and meanwhile, the source voltage of the third thin film transistor is raised;

step 4, entering a drive stage;

first, entering a restore stage, of which the drive stage is initialized, the data signal provides low voltage level, and the nth stage second scan control signal provides low voltage level, and the nth stage first scan control signal provides low voltage level, and the n−1th stage second scan control signal provides low voltage level, and the restore signal provides high voltage level to control activation of the second thin film transistor, and the source voltage of the third thin film transistor is pulled down to the earth voltage level to make gate-source voltages of the third and the fourth thin film transistors equal in order to simplify the data signal to increase a charge time of the data signal with Δt; wherein the third thin film transistor and the fourth thin film transistor are symmetrically located; the fourth thin film transistor is a drive thin film transistor, and the third thin film transistor is a mirror thin film transistor;

then, entering the following stage of the drive stage, the restore signal, which is an n+1th stage first scan control signal, is changed to be low voltage level to control deactivation of the second thin film transistor, and the organic light emitting diode emits light to ensure stresses of gate-source voltages of the drive thin film transistor and the mirror thin film transistor close to each other;

wherein in a combination of the mirror thin film transistor and the drive thin film transistor that are arranged such that the gates of mirror thin film transistor and the drive thin film transistor are connected to each other and the drain of the drive thin film transistor is connected to the earth voltage level, the source of the mirror thin film transistor is connected to the earth voltage level via the second thin film transistor, wherein the source voltage of the mirror thin film transistor is pulled down to the earth voltage level after a single pulse of the data signal is fed to the combination of the mirror thin film transistor and the drive thin film transistor so as to have gate-source voltages of the mirror thin film transistor and the drive thin film transistor equal to each other.

9. The AMOLED pixel driving method according to claim 8, wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

* * * * *